United States Patent [19]

Sandoval

[11] Patent Number: 4,756,522

[45] Date of Patent: Jul. 12, 1988

[54] COMPACT ADJUSTABLE CHEST EXERCISE DEVICE

[76] Inventor: Alfredo R. Sandoval, Casilla 165, Tacna, Peru

[21] Appl. No.: 918,400

[22] Filed: Oct. 14, 1986

[51] Int. Cl.[4] ..... A63B 23/02

[52] U.S. Cl. ..... 272/68; 272/137

[58] Field of Search ..... 272/67, 68, 140, 126, 272/137, 116

[56] References Cited

U.S. PATENT DOCUMENTS

| | | | |
|---|---|---|---|
| D. 208,787 | 10/1967 | Prescott . | |
| D. 264,737 | 6/1982 | Cooper | D21/198 |
| D. 264,739 | 6/1982 | Cooper | D21/198 |
| D. 277,593 | 2/1985 | Terrian et al. | D21/198 |
| 1,229,658 | 6/1917 | Sandow | 272/68 |
| 2,529,347 | 11/1950 | Mohler et al. | 272/83 |
| 2,806,699 | 9/1957 | Spooner | 272/83 |
| 3,349,621 | 10/1967 | Mullen | 73/380 |
| 3,497,216 | 2/1970 | Feather | 272/137 |
| 3,592,647 | 7/1971 | Pereira | 272/83 |
| 4,623,141 | 11/1986 | Salvino | 272/68 |

FOREIGN PATENT DOCUMENTS

| | | | |
|---|---|---|---|
| 2235195 | 2/1974 | Fed. Rep. of Germany . | |
| 1297841 | 12/1962 | France . | |
| 39613 | 11/1907 | Switzerland | 272/140 |
| 1242801 | 8/1971 | United Kingdom | 272/83 R |

*Primary Examiner*—David A. Scherbel
*Assistant Examiner*—Caroline D. Dennison
*Attorney, Agent, or Firm*—Cahill, Sutton & Thomas

[57] ABSTRACT

A compact chest exerciser includes two palm-gripping plates having surfaces contoured to fit the palms of a pair of human hands. The legs of a plurality of removable V-shaped springs are attached, respectively, to ends of the palm-gripping plates to hold the palm-gripping plates in a V-shaped configuration. A user presses the palms of his hands against the contoured surfaces of the palm gripping plates, holding the device in front of his or her chest, and presses his palms together in a "clapping" motion against the resistance of the springs.

12 Claims, 2 Drawing Sheets

FIG. 5
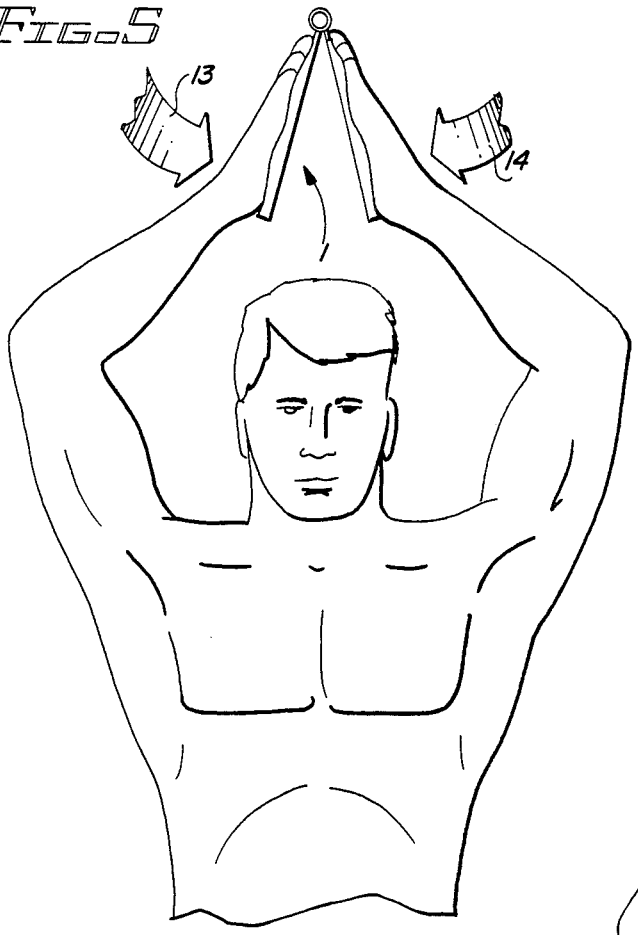
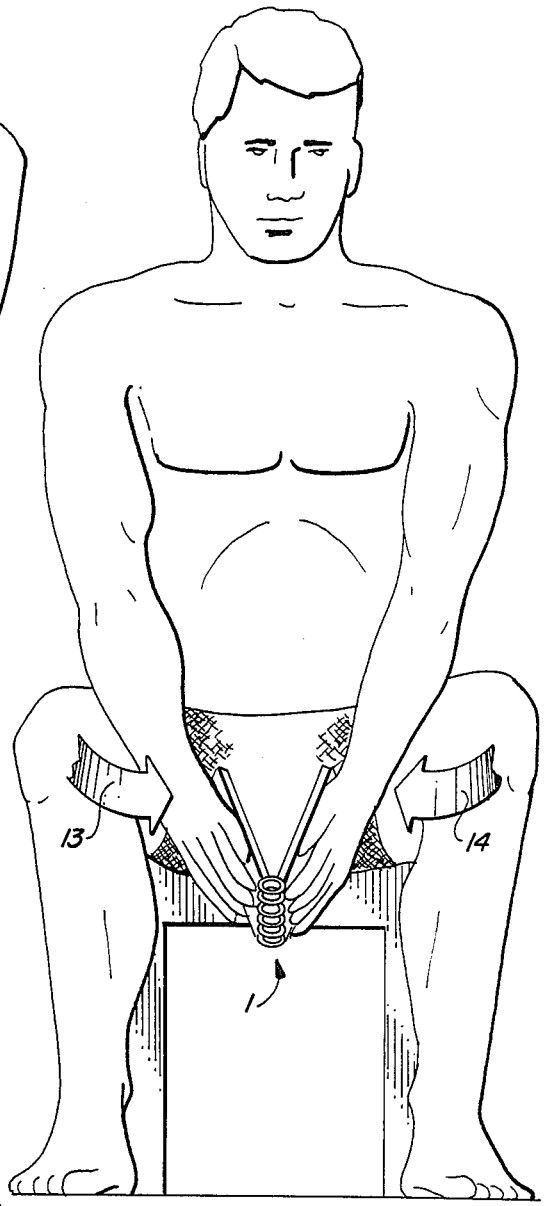
FIG. 7
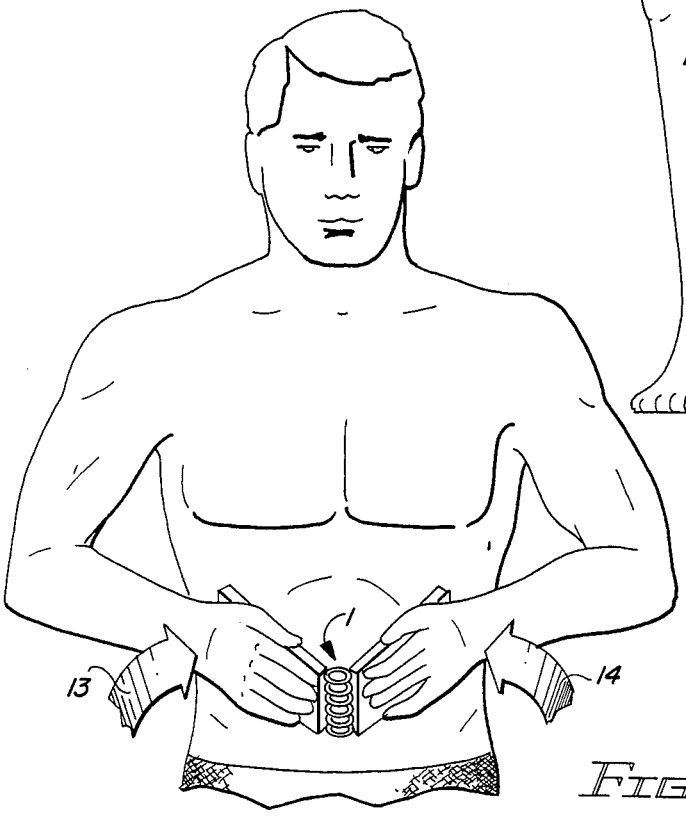
FIG. 6

COMPACT ADJUSTABLE CHEST EXERCISE DEVICE

BACKGROUND OF THE INVENTION

The invention relates to portable, compact exercise devices.

Quite a variety of compact muscle-building devices are known. Many include a pair of handles attached to movable structural members that are pressed together or pulled apart against the resistance of a plurality of removable springs. The number of springs utilized can be adjusted to suit the needs of the user. The user grips the handles and forces them to move together against the resistance of the springs. The state of the art is generally indicated in U.S. Pat. Nos. 4,557,479, 3,349,621, 2,806,699, 2,529,347, Des. 277,593 and Des. 208,787. None of the prior devices has the combination of features including being very compact, easily stored in a suitcase or the like, having easily adjustable resistance, and having an attractive appearance.

SUMMARY OF THE INVENTION

It is an object of the invention to provide a compact exercising device that can be conveniently and easily stored, for example, in a suitcase or travel bag, and can be easily utilized almost anywhere and at any time to exercise chest, wrist, arm, shoulder, back, and stomach muscles, and can be easily adjusted to vary its resistance to suit the needs of the user.

Briefly described, and in accordance with one embodiment thereof, the invention provides a compact exerciser including first and second palm-gripping plates, each having an outer surface contoured to match the contour of a human hand, and a plurality of V-shaped spring elements connecting the palm-gripping plates together in a V-shaped configuration. A user presses the two palm-gripping plates together by pressing his or her palms against the palm-gripping plates as if the clap the hands together. The contour of the palm-gripping plates prevents the palms from slipping. In the described embodiment of the invention, the springs are removable, so the number of springs utilized can be selected to adjust the resistance encountered. The ends of the legs of the V-shaped springs include eyelets extending into recesses in the end portions of the palm-gripping plates. A keeper pin extending transversely through holes in the end of the palm-gripping plates, passing through eyelets of the springs, allowing the palm-gripping plates to be pivoted so they are parallel, to facilitate convenient storage of the device. By holding the exercise device between the palms and pressing the palm-gripping plates together at various locations above the head, in front of the chest and abdomen and front of the waist, the user can effectively exercise his or her back, shoulder, chest, and abdominal muscles. The structure of the device is very unlike that of prior exercising devices, and is believed to have a much more pleasing basic appearance, especially to women users, making regular exercise with the device more likely.

BRIEF DESCRIPTION OF THE DRAWINGS

FIGS. 5–7 are diagrams useful in explaining use of the exerciser of FIG. 1.

DESCRIPTION OF THE INVENTION

Figure 1:
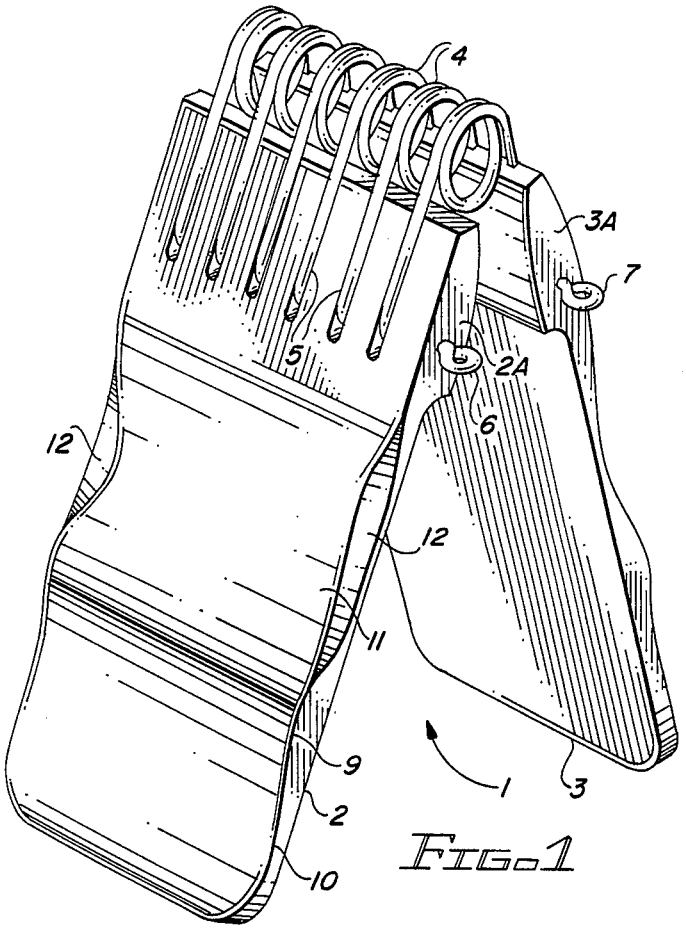
FIG. 1 is a perspective view of the exerciser of the present invention.

Referring now to the drawings, exerciser 1 includes a first palm-gripping plate 2, a second palm-gripping plate 3, and six generally V-shaped springs 4 each having two legs attached to the upper ends of palm-gripping plates 2 and 3, respectively.

The outer surfaces of palm-gripping plates 2 and 3 each have a concave contour 10 that fits the portion of the palm of a user closest to his wrist. Adjacent to the shallow concave recess 10 is a raised convex contour 9 that extends into the middle of the user's palm. Above raised contour 9 is another slightly concave recess 11 into which the portion of the hand at the base of the fingers extends. The sides 12 of recess 11 are contoured more deeply to accommodate and receive pressure of the thumb and smallest finger of the hand. This structure has been found to be ideal for preventing the palms of the hand of the user from slipping forward toward the upper end of the exerciser as the user presses palm-gripping plates 2 and 3 together as if to clap his or her hands against the resistance of the exerciser 1 to exercise his or her chest, shoulder, back, and abdomen muscles.

Figure 2:
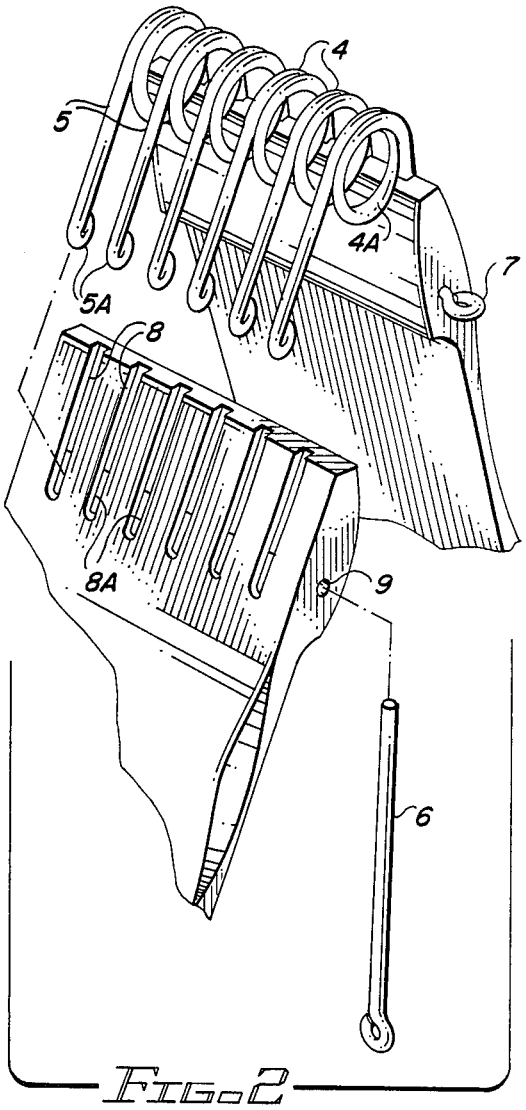
FIG. 2 is a partial exploded view of the exerciser of FIG. 1.
Figure 3:
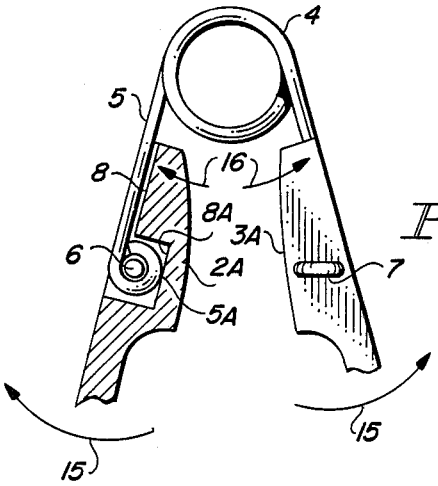
FIG. 3 is a partial cutaway section view of the exerciser of FIG. 1.
Figure 4:
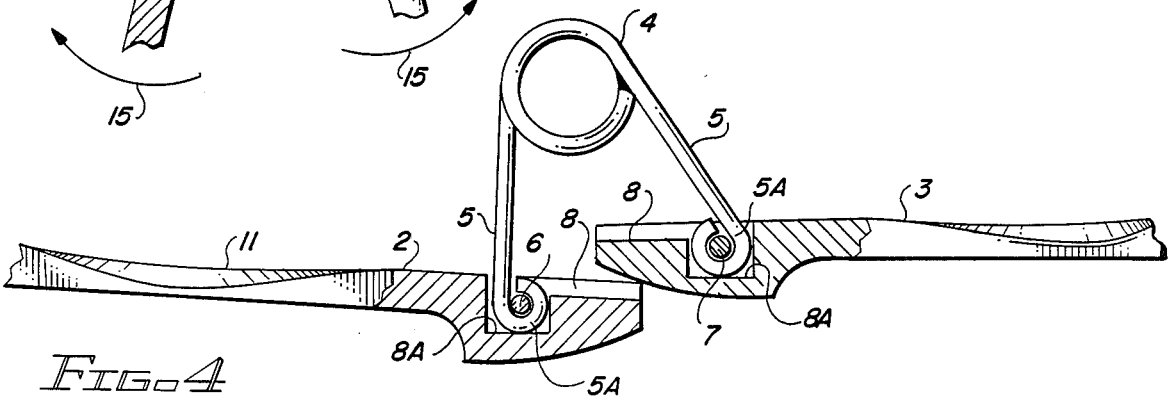
FIG. 4 is a partial cutaway section view useful in describing disassembly and configuration of the exerciser for storage.

As shown in FIGS. 2–4, each of the V-shaped springs 4 is composed of a single piece of spring wire shaped to form a loop 4A from which two arms 5 extend downward at an angle of about 45 degrees. At the lower end of each of the arms 5 an eyelet 5A is formed.

Each of the palm-gripping plates 2 and 3 has six longitudinal grooves 8 defined in the outer surface thereof, each three-sixteenths of an inch deep. Each of the longitudinal grooves extends from the upper end of the palm-gripping plate approximately 1 inch downward along the outer surface thereof. The lower end 8A of each of the grooves 8 is deeper (three-eighths of an inch) than the upper portion, as best seen in FIGS. 3 and 4, to receive the eyelets 5A. The shank portion of the arms 5 rest in the shallower upper portions of the grooves 8.

A plurality of aligned holes such as 9 are provided in the upper end of each of the palm-gripping plates 2 and 3 so that keeper pins 6 and 7 extend through the eyelets 5A of the springs 4 when the eyelets 5A are positioned in the deep portions 8A of the grooves 8. The keeper pins 6, each of which includes a straight shank portion and an enlarged end by means of which the keeper can be manipulated, lock the eyelets 5A of the springs 4 to the upper ends of the palm-gripping plates 2 and 3.

Thus, two, three, or four of the springs 4 can be removed to reduce the force that must be applied to the portions 10 of the palm-gripping plates 2 and 3 to force them together.

The palm-gripping plates 2 and 3 can be pivoted, as indicated by arrows 15 in FIG. 3, about the keeper pins 6 and 7 so that palm-gripping plates 2 and 3 are parallel, as shown in FIG. 4. This open configuration is more convenient for storing the exerciser 1 in a suitcase or handbag than the "closed" configuration shown in FIG. 1. (Alternately, a rigid clip could be provided to clamp the lower ends of palm-gripping plates 2 and 3 together for temporary storage, if desired.)

The distance between the axes of keeper pins 6 and 7 and the upper end of the grooves 8 is approximately 1 inch. This distance, combined with the one-half inch thickness of the upper end portions 2A and 3A of palm-gripping plates 2 and 3 is sufficient to apply the forces indicated by arrows 16 in FIG. 3 against the spring arms 5 to avoid any deformation or breaking of the palm-gripping plate material when the palm-gripping plates are forced together.

The palm-gripping plates are preferably molded from suitable plastic, although metal or hardwood also can be used. The length of the palm-gripping plates 2 and 3 is six and seven-eighths inches in the prototype I have constructed. The width of the plates is three and five-eighths inches at its upper end and two and seven-eighths inches at its lower end. The depths of the palm receiving recesses 10 and 11 are one-eighth of an inch. The maximum thickness of the portion of the palm-gripping plates 2 and 3 below the enlarged head portions 2A and 3A is three-eighths of an inch. The maximum thickness of the enlarged head portions 2A and 3A is one-half of an inch. The springs 4 are formed of one-eighth of an inch diameter spring steel pieces seven and three-fourths inches long. The radius of curvature of the loops 4A is three-eighths of an inch.

Several of my friends and members of my family have utilized the above-described exerciser for testing purposes, and have found that it is easily used by both men and women to exercise the back and shoulder muscles when used in the fashion indicated in FIG. 5, wherein arrows 13 and 14 indicate pressure applied by the palms of the user's hands to the concave contours 10 of the palm-gripping plates 2 and 3. If the exerciser is held directly in front of the chest, maximum exercising of the user's chest muscles occurs. Additional muscles are stressed if the exerciser is used in various other positions, such as the positions shown in FIGS. 6 and 7.

To summarize, the above-described exerciser can be utilized to firm and strengthen chest muscles, back, and abdomen muscles, and also to exercise the wrists, arms and shoulders by merely holding the exerciser above, in front of, or below the waist and pressing the palm-gripping plates together in a "clapping" type of motion. The device can be easily disassembled and reassembled and adjusted to various resistances, easily stored, and used by all members of a family, at almost any time and at almost any place.

While the invention has been described with reference to a particular embodiment thereof, those skilled in the art will be able to make various modifications to the described embodiment without departing from the true spirit and scope of the invention.

I claim:

1. A compact portable exercise device comprising in combination:

(a) first and second palm-gripping plates each having an upper end portion, a lower end portion, an inner surface, and an outer surface, a thickness substantially less than its length and width, the outer surface having a first concave portion adjacent to the lower end portion receiving the base of a user's open palm, a convex portion located above the first concave portion and extending into the middle of the user's open palm, and a second concave portion above the convex portion receiving the portion of the user's open palm at the base of the user's fingers, to thereby prevent the user's open palm from slipping on the outer surface as the user presses the outer surfaces together;

(b) a plurality of V-shaped compression springs each having a first leg and a second leg; and (c) first attaching means for attaching the upper end portion of the first palm-gripping plate to the first leg of each of the V-shaped compression springs and second attaching means for attaching the upper end portion of the second palm-gripping plate to the second leg of each of the V-shaped compression springs so that the outer surfaces of the first and second palm-gripping plates are substantially inclined to one another.

2. The compact, portable exercise device of claim 1 wherein each of the V-shaped compression springs includes an eyelet at a free end of each of its first and second legs, and wherein the upper end portion of each of the first and second palm-gripping plates includes a plurality of grooves, the grooves of the first palm-gripping plate receiving the first legs and eyelets of the respective V-shaped compression springs and applying compressive force from the first palm-gripping plate to the first legs of the V-shaped compression spring, the grooves of the second palm-gripping plate receiving the second legs and eyelets of the respective V-shaped comrpession springs and applying compressive force from the second palm-gripping plate to the second legs of the V-shaped compression springs.

3. The compact portable exercise device of claim 2 wherein the first attaching means includes transverse holes extending through the upper end portion of the first palm-gripping plate and aligned with the eyelets of the first legs, respectively, and a first keeper pin extending through those transverse holes and the eyelets of the first legs, and wherein the second attaching means includes transverse holes extending through the upper end portion of the second palm-gripping plate and aligned with the eyelets of the second legs, respectively, and a second keeper pin extending through those transverse holes and the eyelets of the second legs.

4. The compact portable exercise device of claim 3 wherein the portions for the grooves receiving the eyelets are deeper than the portions of the grooves receiving the legs of the V-shaped compression springs, the transverse holes receiving the first and second keeper pins being located a predetermined distance from upper ends of the first and second palm-gripping plates, respectively.

5. The compact portable exercise device of claim 4 wherein each of the V-shaped compression springs is composed of spring steel and each includes a single loop from which the first and second legs of that V-shaped compression spring extend.

6. The compact portable exercise device of claim 5 wherein the predetermined distance is approximately one inch, and wherein the length of the first and second palm-gripping plates is approximately seven inches and wherein the maximum width of the first and second palm-gripping plates is approximately three and one-half inches.

7. The compact portable exercise device of claim 6 wherein the angle between the first and second palm-gripping plates is approximately 45 degrees.

8. The compact portable exercise device of claim 1 wherein the outer surfaces of the first and second palm-gripping plates include concave contours along opposed edges of the outer surfaces contacting the thumbs and smallest fingers of the hands of the user to further resist slipping of the user's hands on the outer surfaces.

9. A method of using a compact portable exercise device comprising the steps of:

(a) providing first and second palm-gripping plates each having an upper end portion, an inner surface, and an outer surface and having a thickness substantially less than its width and length;

(b) providing a contour in the outer surface of each of the first and second palm-gripping plates, the contour including first and second concave contours and a convex contour between the first and second concave contours and fitting the open palm of the hand of the user in the outer surface of each of the first and second palm-gripping plates, respectively;

(c) providing a plurality of V-shaped compression springs each having a first leg and a second leg and attaching the first legs to the upper end portion of the first palm-gripping plate and attaching the second legs to the upper end portion of the second palm-gripping plate so that the outer surfaces of the first and second palm-gripping plates are substantially inclined to one another; and (d) pressing the open palms of a user's right and left hands against the contours of the outer surfaces of the first and second palm-gripping plates, respectively, holding the compact portable exerciser with outstretched arms, and respectively pressing the palms of the right and left hands together against the resistance provided by the V-shaped springs, the first and second concave contours and the convex contours preventing the user's palms from slipping.

10. The method of claim 9 wherein step (d) includes the user pointing his or her outstretched arms in an overhead direction.

11. The method of claim 9 wherein step (d) includes the user pointing his or her otustretched arms in front of the user.

12. The method of claim 9 wherein step (d) includes the user pointing his or her outstretched arms downward.

* * * * *